United States Patent [19]

Vecchia

[11] 4,050,270

[45] Sept. 27, 1977

[54] APPARATUS FOR WASHING AND SCOURING FABRICS

[75] Inventor: Gino Dalla Vecchia, Santorso (Vicenza), Italy

[73] Assignee: Sperotto Brevetti S.p.A., Carre', Italy

[21] Appl. No.: 682,974

[22] Filed: May 4, 1976

[30] Foreign Application Priority Data

May 5, 1975 Italy ..... 23008/75

[51] Int. Cl.[2] ..... D06B 3/28

[52] U.S. Cl. ..... 68/158; 68/177; 68/207

[58] Field of Search ..... 68/DIG. 5, 158, 177, 68/178, 181 R, 183, 184, 207

[56] References Cited

U.S. PATENT DOCUMENTS

| | | | |
|---|---|---|---|
| 3,199,126 | 8/1965 | Chaikin et al. | 68/158 X |
| 3,712,085 | 1/1973 | Guberman et al. | 68/207 X |
| 3,894,412 | 7/1975 | Fleissner | 68/DIG. 5 |

FOREIGN PATENT DOCUMENTS

| | | | |
|---|---|---|---|
| 467,128 | 8/1950 | Canada | 68/158 |
| 15,810 | 6/1970 | Japan | 68/184 |
| 23,720 | 7/1972 | Japan | 68/207 |

*Primary Examiner*—Philip R. Coe
*Attorney, Agent, or Firm*—Karl W. Flocks

[57] ABSTRACT

An apparatus for washing and scouring fabrics by means of a washing liquid, comprising a tub filled with washing liquid and a cylinder rotatable inside the tube and forming the driving means for the fabric. The latter, passing in the space between the cylinder and the bottom of the tub, is subjected to opposite jets of washing liquid impulsively emitted by opposite pairs of ejectors, whereby a continuous motion of the fabric is caused to take place and the washing liquid is continuously vibrating.

2 Claims, 3 Drawing Figures

APPARATUS FOR WASHING AND SCOURING FABRICS

The present invention relates to an apparatus for washing and scouring fabrics.

The apparatus according to the invention is essentially characterized by comprising a tub, filled with washing liquids, a cylinder having a perforated side wall rotating inside said tub, so as to form a driving element for a fabric to be washed, which is passed between the tub and the cylinder and a series of pairs of opposed ejectors, positioned in fixed positions at both sides of the fabric along the course thereof between the tub and the cylinder, the ejectors being simultaneously impulsively fed with washing liquid so as to simultaneously direct washing liquid jets from opposite sides against the fabric to be washed, one ejector of each pair being mounted inside the cylinder and communicating with the space between the tub and the cylinder through the perforated wall of the cylinder, the other ejector of the same pair being mounted outside of the tub and communicating with the said space between the tub and the cylinder through at least an opening formed in the bottom of the tub.

Essentially, by the apparatus according to the present invention the washing and the scouring of the fabric are carried out by means of opposed jets of washing liquid (e.g. solvent) impinging repeatedly and in every time different points against the fabric, whereby these jets, by imparting to the fabric a continuous movement and causing at the same time a vibration of all the liquid contained in the tub (the liquid level being of course higher than that of the ejectors), promote and enhance the washing and the scouring of the fabric.

If the fabric to be washed is a knitted fabric of the jersey type, namely a fabric for which notoriously the best results are obtained when a certain permanency in the solvent is combined with the mechanical washing, it is foreseen to adjust the feeding and the removing rate of the fabric so as to cause an accumulation (or "reserve") of fabric into the space between the tub and the cylinder: in this case, by the impulsive jets of washing liquid which are provided by the apparatus according to the present invention, a remarkable and favourable relaxation of the fabric is obtained.

On the contrary, if a particular fabric is to be treated, which either cannot abandon the conveying support as formed by the perforated cylinder (for instance in the case of a tubular jersey), or can not undergo an extended permanency in the washing liquid, the feeding and removing rates of the fabric shall be adjusted so that the fabric passes between the tub and the cylinder and is wound thereonto, without accumulation.

The features of the present invention shall be better understood through the reading of the following detailed description of a preferred embodiment, shown as a non limiting example in the enclosed drawings, in which.

Figure 1:
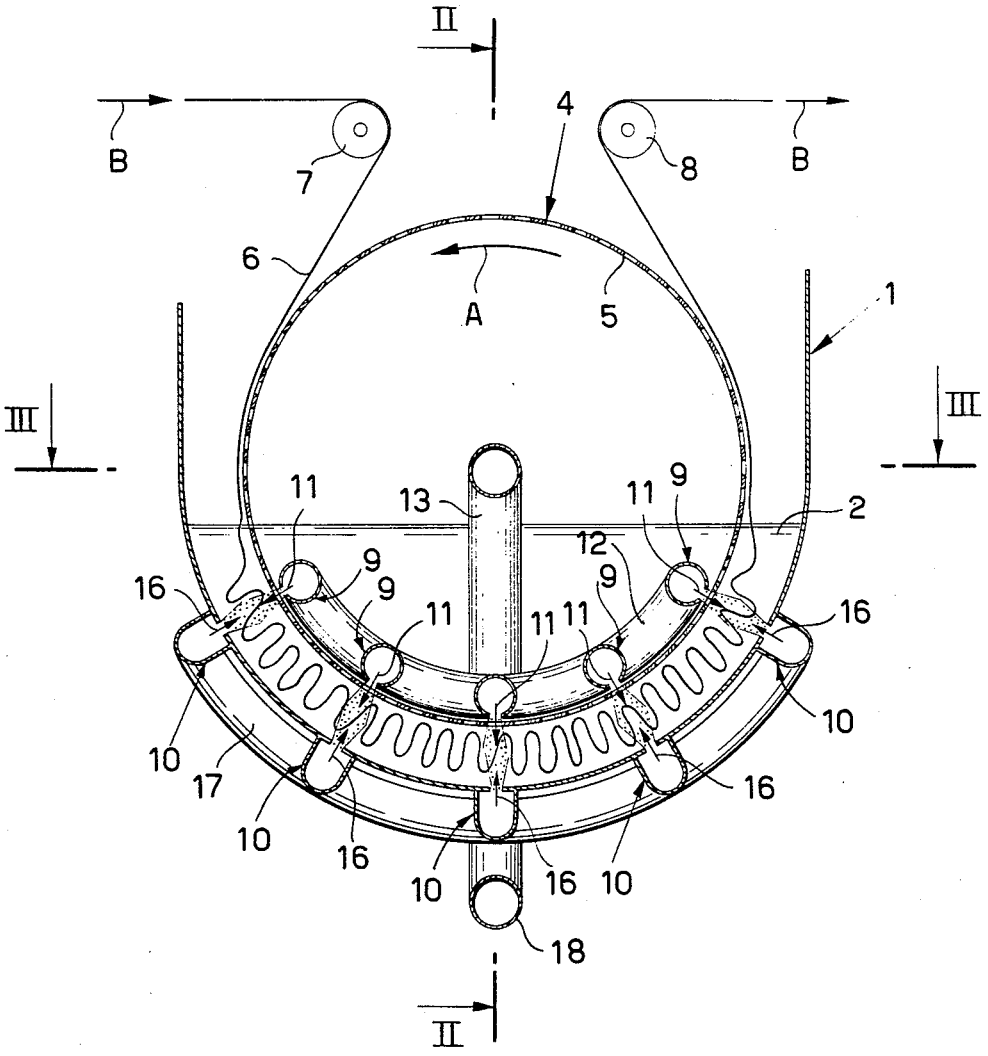
FIG. 1 shows the section of the apparatus according to the present invention along a vertical plane passing through the line 1—1 of FIG. 2.
Figure 2:
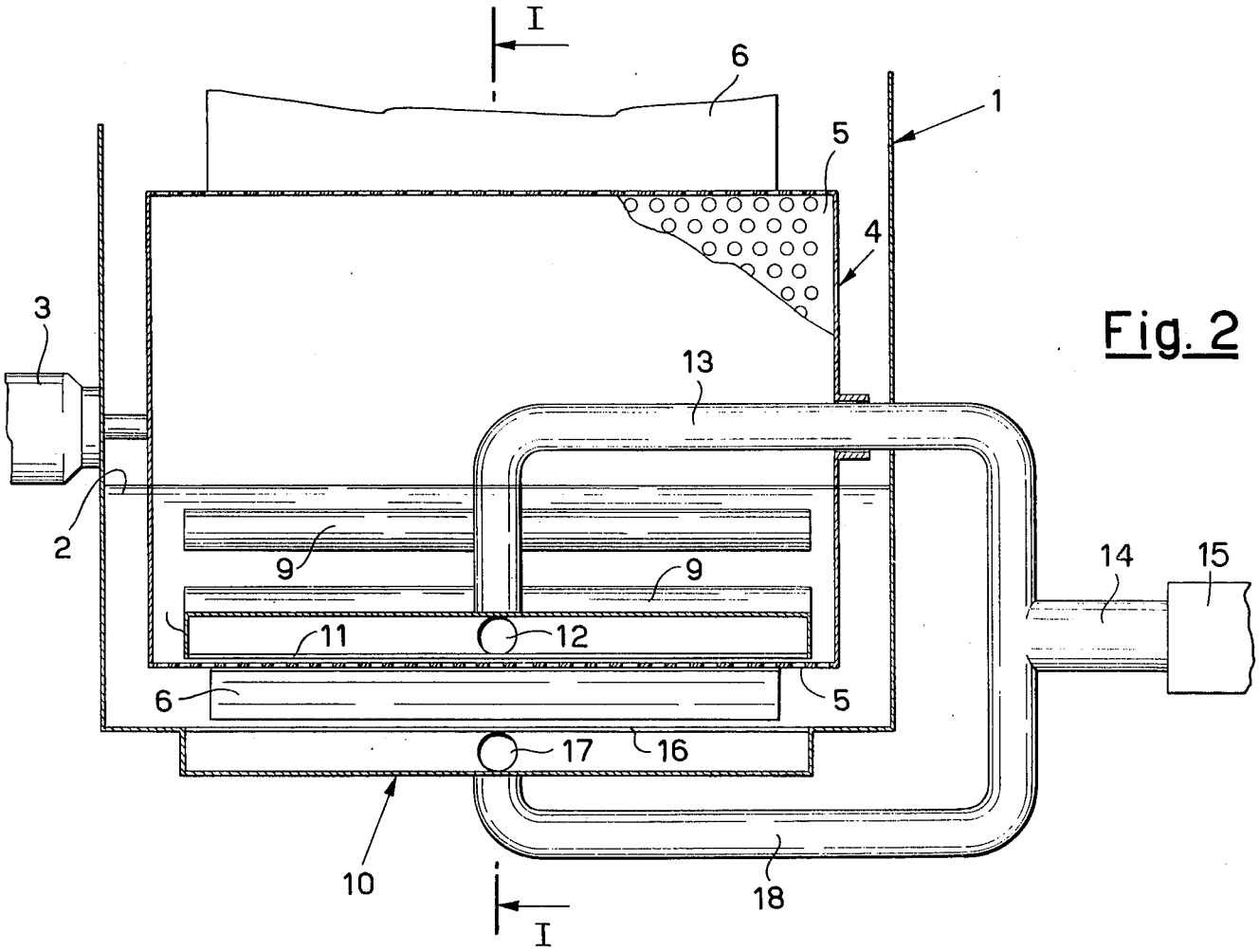
FIG. 2 shows the cross-section of the apparatus according to another plane passing through the line II—II of FIG. 1.
Figure 3:
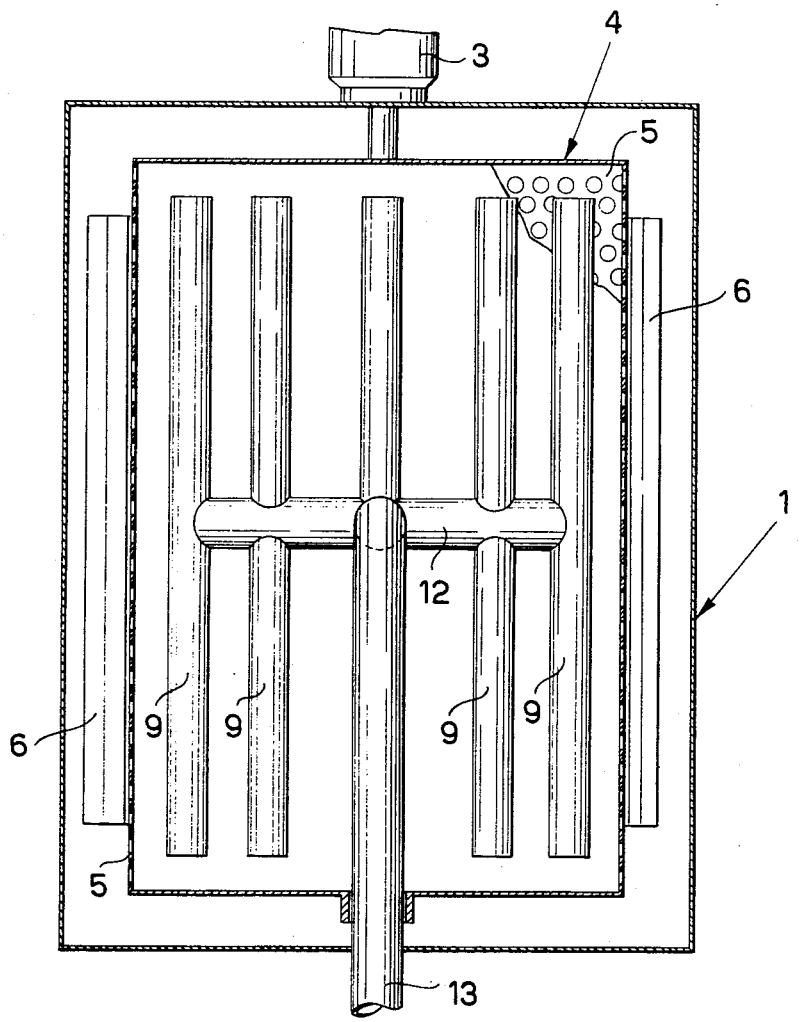
FIG. 3 shows the cross-section of the said apparatus according to a horizontal plane passing through the line III—III of FIG. 1.

The apparatus shown in the drawings comprises a tub 1, which is partially filled with solvent or another washing liquid 2 (for example a chlorinated solvent), a cylinder 4 having a perforated side wall 5 being rotated within the tub by a motor 3 (FIG. 2) according to the direction of the arrow A of FIG. 1.

In the semi-annular space, as defined between the cylinder 4 and the bottom of the tub 1, the fabric 6 to be washed is passed, the advancing thereof in the direction of the arrows B of FIG. 1 being controlled by a feeding roller 7 and by a removing roller 8, which in the considered example are adjusted so as to cause a certain accumulation or "reserve" of fabric immersed in the solvent to be present. Thus, a permanency of the fabric in the same solvent is ensured.

The portion of the fabric which is each time present in the semi-annular space as defined between the tub and the cylinder is subjected to periodical opposed jets of solvent or other washing liquid (particularly the same solvent which is present in the tub, by suitably recycling it), which give place to the washing, the scouring and the relaxation thereof. These jets, which are simultaneously emitted, are originated by a series of pairs of opposed ejectors 9 and 10, which are distributed in fixed positions at both sides of the fabric along the course thereof between the tub and the cylinder (FIG. 1).

The ejectors 9, which are provided with their own dispensing slit 11, are positioned inside the cylinder 4 and communicate with the said space between the tub and the cylinder through the perforated side wall of the cylinder itself. Furthermore, the ejectors terminate at a common header 12, which is connected through a common U-shaped piping 13 to a feeding duct 14, the latter being provided at its inlet with a solvent feeding device of impulsive type 15, namely a feeding device (for example, a centrifugal pump with an opening-closing valve, a volumetric piston pump, and so on), capable of impulsively dispensing solvent at suitably spaced times.

The ejectors 10 are in turn positioned outside of the tub 1 and communicate with the said space between the tub and the cylinder through suitable slits 16 formed in the bottom of the tub. Moreover, a common header 17 is provided for the ejectors, which is connected by a U-shaped piping 18 to the already mentioned feeding duct 14.

The ejectors 9 and 10 are then simultaneously and impulsively fed with solvent by the feeding device 15 through the common feeding duct 14, the U-shaped pipings 13 and 18 and the headers 12 and 17, respectively. The impulsive jets of solvent are thus simultaneous, and are directed against opposite sides of the fabric to be washed.

As the fabric is advanced in the direction indicated by the arrows B in FIG. 1 and the cylinder 4, having only conveying and driving function, is rotated in the direction of the arrow A in FIG. 1, the impulsive solvent jets as originated by the ejectors 9 and 10 are thus capable of causing a continuous motion of the fabric and giving place to a continuous vibration of the solvent already present in the tub, which manifestly promote and enhance the washing and scouring action of the solvent. The fabric is moreover subjected to an advantageous relaxing effect.

I claim:

1. Apparatus for washing and scouring fabric comprising a tub containing washing liquid and having a wall with at least one opening therethrough, a cylinder mounted for rotation in said tub and having a perforated side wall forming a driving element for the fabric to be washed and scoured, said cylinder having its said side wall spaced from the interior of said tub forming a space therebetween to permit the fabric being washed and scoured to pass through said space between said cylinder side wall and the interior of said tub, a series of pairs of washing liquid jet ejectors with each of one of the ejectors of said pairs of ejectors mounted inside said cylinder and communicating with said space between said cylinder side wall and the interior of said tub through said perforated wall of said cylinder, and with each of the other of the ejectors of said pairs of ejectors mounted outside said tub and communicating with said space between said cylinder side wall and the interior of said tub through said at least one opening in said wall of said tub, said one of the ejectors and said other of the ejectors of each of said pairs of washing liquid ejectors mounted for emitting opposing jet flows of washing liquid toward each other from said ejectors, and means for producing a pulsating flow of washing liquid from said ejectors, connected to said ejectors.

2. Apparatus according to claim 1, further characterized by feeding means for advancing the fabric in said space between said cylinder side wall and the interior of said tub, removing means for removal of the fabric from said space, and means to adjust said feeding means and said removing means to cause an accumulation of the fabric in said space.

* * * * *